US005971745A

United States Patent [19]

Bassett et al.

[11] Patent Number: 5,971,745

[45] Date of Patent: Oct. 26, 1999

[54] FLAME IONIZATION CONTROL APPARATUS AND METHOD

[75] Inventors: William W. Bassett, Wheaton, Ill.; Karen Benedek, Winchester, Mass.; Philip Carbone, Everett, Mass.; Stephan Schmidt; Peter Cheimets, both of Winchester, Mass.

[73] Assignee: Gas Research Institute, Chicago, Ill.

[21] Appl. No.: 08/747,777

[22] Filed: Nov. 13, 1996

Related U.S. Application Data

[60] Provisional application No. 60/006,543, Nov. 13, 1995.

[51] Int. Cl.[6] ..... F23N 5/112

[52] U.S. Cl. ..... 431/12; 431/78; 431/25; 431/75

[58] Field of Search ..... 431/12, 75, 78, 431/25

[56] References Cited

U.S. PATENT DOCUMENTS

| | | | |
|---|---|---|---|
| 3,741,166 | 6/1973 | Bailey | 431/23 |
| 4,118,172 | 10/1978 | Noir et al. | 431/12 |
| 4,296,727 | 10/1981 | Bryan | 126/116 |
| 4,298,335 | 11/1981 | Riordan et al. | 431/25 |
| 4,348,169 | 9/1982 | Swithenbank et al. | 431/12 |
| 4,405,299 | 9/1983 | Serber | 431/78 |
| 4,444,551 | 4/1984 | Mueller et al. | 431/25 |
| 4,461,615 | 7/1984 | Inoue | 431/76 |
| 4,474,548 | 10/1984 | Miyanaka et al. | 431/1 |
| 4,501,127 | 2/1985 | Sommers et al. | 62/238.3 |
| 4,507,702 | 3/1985 | Grewe | 361/161 |
| 4,508,501 | 4/1985 | Kühn | 431/2 |
| 4,516,930 | 5/1985 | Dietz | 431/26 |
| 4,533,315 | 8/1985 | Nelson | 431/20 |
| 4,541,407 | 9/1985 | Sommers et al. | 126/39 E |
| 4,545,208 | 10/1985 | Kühn | 60/648 |
| 4,568,266 | 2/1986 | Bonne | 431/76 |
| 4,585,631 | 4/1986 | Pfeiffer | 423/235 |
| 4,588,372 | 5/1986 | Torborg | 431/12 |
| 4,591,337 | 5/1986 | Gillhaus | 432/138 |
| 4,645,450 | 2/1987 | West | 431/12 |
| 4,659,306 | 4/1987 | Altemark et al. | 431/12 |
| 4,662,838 | 5/1987 | Riordan | 431/25 |

(List continued on next page.)

FOREIGN PATENT DOCUMENTS

| | | | |
|---|---|---|---|
| 0 021 035 | 8/1983 | European Pat. Off. | F23D 13/00 |
| 0104586 | 4/1984 | European Pat. Off. . | |
| 0 352 433 | 1/1990 | European Pat. Off. | F23D 21/00 |
| 0 697 637 | 2/1996 | European Pat. Off. | G05B 9/02 |
| 2 666 401 | 3/1992 | France | F23D 14/72 |
| 36 30 177 | 3/1988 | Germany | F23N 1/02 |
| 195 02 901 | 3/1996 | Germany | F23N 5/12 |
| 44 33 425 | 3/1996 | Germany | F23N 5/12 |
| 195 02 900 | 8/1996 | Germany | F23N 5/12 |
| 195 02 905 | 8/1996 | Germany | F23N 5/12 |
| 195 24 081 | 1/1999 | Germany | F23N 5/24 |
| 52-13139 | 2/1977 | Japan . | |
| 56-157725 | 12/1981 | Japan . | |
| 59-189215 | 10/1984 | Japan | F23N 5/12 |
| 59-221519 | 12/1984 | Japan | F23N 5/00 |
| 62-258928 | 11/1987 | Japan | F23N 5/12 |
| 2-302520 | 12/1990 | Japan | F23N 5/12 |
| 3-156209 | 7/1991 | Japan | F23N 5/12 |
| 6-42741 | 2/1994 | Japan | F23N 5/10 |
| 60-93231 | 5/1998 | Japan | F23N 5/08 |
| 8403840 | 7/1986 | Netherlands . | |
| 710805 | 6/1954 | United Kingdom | 75/1 |
| 1193976 | 6/1970 | United Kingdom | 27/62 |
| 81/01605 | 6/1981 | WIPO | F23Q 23/00 |

OTHER PUBLICATIONS

Patent Abstracts of Japan, vol. 006, No. 043 (M–117), Mar. 17, 1992 & JP 56 157725 A (Hitachi Ltd.), Dec. 5, 1991—English lang. doc.

*Primary Examiner*—Carl D. Price
*Attorney, Agent, or Firm*—Pauley Peterson Kinne & Fejer

[57] ABSTRACT

An apparatus and process for controlling the operation of a gas burner, by monitoring and controlling the stoichiometry of the air and fuel gas during the burning process.

28 Claims, 8 Drawing Sheets

U.S. PATENT DOCUMENTS

| | | | |
|---|---|---|---|
| 4,688,547 | 8/1987 | Ballard et al. | 126/116 A |
| 4,695,246 | 9/1987 | Beilfuss et al. | 431/31 |
| 4,729,207 | 3/1988 | Dempsey et al. | 126/112 |
| 4,738,577 | 4/1988 | Schalberger | 414/160 |
| 4,802,142 | 1/1989 | Korsmeier et al. | 366/160 |
| 4,825,198 | 4/1989 | Rolker et al. | 340/605 |
| 4,836,670 | 6/1989 | Geary | 431/46 |
| 4,856,331 | 8/1989 | Roese et al. | 73/268 |
| 4,859,171 | 8/1989 | Altemark et al. | 431/12 |
| 4,866,450 | 9/1989 | Heuss | 432/235 |
| 4,901,567 | 2/1990 | Bertke et al. | 73/272 R |
| 4,927,350 | 5/1990 | Zabielski | 431/12 |
| 4,934,926 | 6/1990 | Yamazaki et al. | 431/12 |
| 4,941,345 | 7/1990 | Altemark et al. | 73/23.2 |
| 4,955,806 | 9/1990 | Grunden et al. | 431/24 |
| 4,960,378 | 10/1990 | Jannemann et al. | 431/114 |
| 4,975,043 | 12/1990 | Katchka et al. | 431/54 |
| 4,982,721 | 1/1991 | Lynch | 126/116 A |
| 5,027,789 | 7/1991 | Lynch | 126/116 A |
| 5,037,291 | 8/1991 | Clark | 431/12 |
| 5,049,063 | 9/1991 | Kishida et al. | 431/78 |
| 5,055,032 | 10/1991 | Altemark et al. | 431/158 |
| 5,073,104 | 12/1991 | Kemlo | 431/12 |
| 5,112,217 | 5/1992 | Ripka et al. | 431/12 |
| 5,158,447 | 10/1992 | Geary | 431/25 |
| 5,158,448 | 10/1992 | Kawasaki et al. | 431/74 |
| 5,169,301 | 12/1992 | Donnelly et al. | 431/20 |
| 5,195,885 | 3/1993 | Medina | 431/25 |
| 5,333,591 | 8/1994 | Korsmeier et al. | 123/527 |
| 5,432,095 | 7/1995 | Forsberg | 436/154 |
| 5,439,374 | 8/1995 | Jamieson | 431/25 |
| 5,472,336 | 12/1995 | Adams et al. | 431/6 |
| 5,472,337 | 12/1995 | Guerra | 431/78 |
| 5,506,569 | 4/1996 | Rowlette | 340/577 |
| 5,534,781 | 7/1996 | Lee et al. | 324/380 |
| 5,548,277 | 8/1996 | Wild | 340/578 |
| 5,549,469 | 8/1996 | Wild et al. | 431/75 |
| 5,556,272 | 9/1996 | Blasko et al. | 431/75 |
| 5,576,626 | 11/1996 | Lo | 324/464 |
| 5,577,905 | 11/1996 | Momber et al. | 431/66 |
| 5,599,180 | 2/1997 | Peters et al. | 431/13 |

FLAME IONIZATION CONTROL APPARATUS AND METHOD

This application depends from Provisional Application Ser. No. 60/006,543, filed Nov. 13, 1995.

BACKGROUND OF THE INVENTION

1. Field of the Invention

The present invention relates generally to the control of gaseous fuel burners as used in various heating, cooling and cooking appliances. In particular, the present invention relates to a method and apparatus for setting and maintaining the proportions of fuel gas to air in the combustible mixture supplied to a power or induced draft, preferably premixed, burner at a desired firing rate.

2. The Prior Art

In the field of gas burner technology, relating to burners such as may be used in furnaces, water heaters, boilers, and the like, it is desirable to control the operation of a burner beyond merely supplying gas and providing air for combustion at a fixed flow rate, and igniting the mixture. Numerous factors must be considered in the construction, placement and operating conditions for a gas burner.

Some prior art appliances provide a fixed air supply to a burner, and must, therefore, not only supply enough air to prevent excessive production of carbon monoxide and oxides of nitrogen under ideal operating conditions, but also must provide a safety margin to account for incidences such as a blocked vent or an overfire condition (i.e., a significant increase in the firing rate above the rated value). Therefore, a standard appliance is typically designed with an excess air level significantly higher than would be required if changes in firing rate or air flow could be compensated for automatically. The additional safety margin of excess air can result in a significant reduction in appliance efficiency. Accordingly, it would be desirable to more closely control the fuel to air ratio.

In certain environments, in which human safety is a consideration, a burner must be operated in such a manner as to avoid the production of certain gases (such as carbon monoxide or oxides of nitrogen), beyond certain defined limits. The provision of air in excess of the applicable stoichiometric ratio for combustion of the particular fuel gas being burned may help to ensure safe operation and burning conditions, but may also create an inefficient operating situation.

Gas burner designs are being made in which the supplies of fuel gas, primary combustion air and secondary combustion air (if such is supplied) are capable of being closely physically controlled in finite increments. It is desirable to provide a method of monitoring the operation of the burner so that the incremental control of the gas and air supplies can be used to the best advantage to facilitate safe, and efficient operation.

It is, in general, a true proposition that a burner, which operates closely to stoichiometric conditions is more efficient than a furnace which is operating, for example, with a large amount of excess air. If the fuel gas is known, and the flow rates of fuel gas and combustion air are known, the actual combustion conditions, relative to stoichiometry are defined.

It is presently becoming popular in the art to provide appliances which have the capability to modulate or vary the fuel flow over a wide range, thus making a wide range of heating capacity (firing rates) available with a single appliance. Modulating capabilities can greatly increase a system's overall efficiency. Two-stage systems, i.e., systems capable of operating at two firing rate levels, are available, but are limited in their scope and range of operation due to their typical inability to precisely control the fuel gas and air mixture, and the need for a wide excess-air safety margin. A continuously modulating appliance, to be effective and efficient, would require close control of the fuel to air ratio. Though it is possible to directly measure the fuel and air flow rates independently and thereby determine the fuel and air mixture, such a detection system would require expensive sensor systems and be complex and possibly overly costly for most appliance applications of interest.

One method of monitoring burner operation, toward controlling same is disclosed in Noir et al., U.S. Pat. No. 4,188,172. In the Noir et al. '172 patent, a control burner is connected in parallel, with regard to the fuel gas and combustion air lines, with a main burner. The control burner is connected to two control loops. The first control loop consists of a waterfiller calorimeter, which surrounds the control burner. This calorimeter is used to determine the heating value of the fuel. The fuel flow is then adjusted to maintain a constant heat flux in the main burner. The second control loop consists of a temperature sensor located at the tip of the control burner flame. The control system of that reference functions on the basis that for a given firing rate, the flame temperature, for example, at the tip, will attain a maximum temperature, when the fuel/air ratio is at or near the theoretical stoichiometric ratio for the particular fuel. The air flow to the control burner is then varied until a peak temperature is reached. Then the air flow to the main burner is set at a predetermined multiple so as to achieve a desired fuel/air ratio in the main burner.

The control system of the Noir et al. '172 reference requires substantial calibration, as well as the provision of an entire, separate, pilot or control burner. Although passing reference is made to the possibility of applying the principles of Noir et al. '172 to other flame characteristics, such as the ionization of burned gases, no disclosure is provided or even remotely alluded to, as to how to practice such application.

Further, the Noir et al. reference is not directed to an apparatus suitable for use at widely varying firing rates. It would be desirable to provide a control apparatus having a method of control which could be provided at low cost, and capable of providing accurate burner control over a wide range of firing rates.

Problems faced by gas burners include performance variations caused by changes in air flow, due to fan/blower degradation and flue blockage, as well as changes in fuel heating value. Variations in burner performance caused by the aforementioned conditions can result in excessive pollutant production, which in turn can be a health and safety hazard. To compensate for these potential problems and provide a large margin of safety, current gas burner equipped appliances operate with a large amount of excess air. This large amount of excess air results in significantly lower system efficiencies.

An additional problem which gas burner equipped appliances, such as furnaces, face, is the effect which altitude has upon performance. At higher altitudes, burners receive air which is less dense, and accordingly, has less oxygen. Accordingly, for appliances which are not capable of modifying their operation in response to the altitude, such apparatus must be derated for altitudes which are different than a "base" or nominal optimum operating altitude (e.g., sea level). For example, it is typical to derate an appliance, such as a furnace, at a rate of −4% per every 1000 feet of increased altitude. That means, for an appliance having a rating of X BTU/hr at sea level, the rating will be X(1−0.04) BTU/hr at 1000 feet elevation.

It would be desirable to provide gas appliances with a way to self regulate, in response to changes in air flow, fuel heating value, and altitude so that substantially constant performance can be obtained, if desired (within the limits of the supply of available fuel and combustion air).

SUMMARY OF THE INVENTION

The present invention is directed to a novel method and apparatus for monitoring the performance of a premixed gaseous fuel burner and controlling the ratio of fuel gas to air in the combustible gas supplied to the burner.

It is known that hydrocarbon gas flames conduct electricity because charged species (ions) are formed by the chemical reaction of the fuel and air. The concentration of these ions is a function of the temperature of the flame, which, in turn, is a function of the ratio of fuel and air supplied, with a peak in the ion concentration (i.e., the greatest amount of ions in the combustion gases, during burning) occurring at or near the stoichiometric fuel and air ratio. When an electric potential is established across the flame, the ions form a conductive path, and a current flows. Using known components, the current flows through a circuit including a flame ionization sensor, a flame and a ground surface (flameholder or ground rod). The higher the ion concentration, the more current will flow. The present invention takes advantage of this relationship between the ion concentration and the ratio of fuel and air in the combustible mixture supplied to the burner. The key characteristic of this relationship is that the current peaks at or near stoichiometric conditions. In the method and apparatus of the present invention, measured variations in the current flow, at a constant electric potential, caused by variations in the ratio of fuel to air are used to derive control parameters which are then used to adjust and maintain the desired fuel to air ratio.

The method and apparatus of the present invention is suitable for use preferably with powered or induced draft premixed burners, employing a variable combustion air supply (such as a variable speed draft fan, which may either be stepped, or preferably completely modulable) and/or a variable supply fuel gas valve (which likewise may be stepped or preferably, fully modulable). The use of a flame ionization sensor and a peak-seeking control scheme provides the opportunity to approach and/or identify the fuel to air ratio corresponding to stoichiometric conditions. This peak response point can be found for any premixed burner, independent of firing rate, altitude or fuel composition.

The invention uses a sensor made of a conductive material, which is capable of withstanding high temperatures and temperature gradients, and an air supply and gas regulating valve, one or both of which must be variable (i.e., at least one setting between "full" and "off"), along with their respective control devices. A typical ionization sensor is configured as a metal rod, which is surrounded for some of its length with a flame resistant ceramic material. Upon start-up of an appliance incorporating the invention, the control devices set the fuel flow and air flow to provide a combustible gas mixture containing some portion of excess air. This mixture is ignited, and the control device allows conditions to stabilize. After the stabilization period, the control device causes a variation in the fuel to air ratio or equivalence ratio. The equivalence ratio is defined as the actual fuel/air ratio divided by the stoichiometric (or ideal) fuel/air ratio. The variation in the fuel to air ratio results in a change in the current flow through the flame. The controller detects the change in the current flow, derives control parameters based on the change of the measurement, and then modifies the fuel/air flow based on the derived control parameters. At the new fuel/air flow, the control device measures the change in current, derives new control parameters, and again modifies the fuel/air flow based on the derived control parameters. This procedure is repeated until a peak current flow is either approached or obtained.

The peak current flow typically corresponds to the stoichiometric ratio of fuel and air (for some fuels and combustion environments, the stoichiometric ratio corresponds to a point slightly off-peak). Once the peak is either anticipated or achieved and a known fuel to air ratio has been established, the control device can offset to any desired level of excess air by a simple multiplication factor applied to the fuel/air flow rate. Once the desired ratio of fuel to air is set, the sensor monitors the current signal in order to determine if burner operation deviates from the desired point. If the fuel to air ratio changes due to events remote from the control device, the control device will detect the change in current, reestablish the air and fuel flows used at start-up, and then repeat the previously described process to establish the desired level of excess air.

The advantage of the above-described method and apparatus for establishing a desired fuel to air ratio in a premixed burner is that the process is independent of the absolute amount of fuel flow, i.e., the firing rate. Therefore, if an appliance is equipped with a widely or fully variable gas regulating valve, the invention can be used to control the fuel to air ratio over a wide range of gas flow rates, thus allowing an appliance to modulate its heating capacity, while still maintaining a desired level of excess air.

For a modulating appliance, the start-up procedure would follow the same steps as outlined previously. Once the desired level of excess air has been reached, the sensor will monitor the current in order to determine if burner operation deviates from the desired point. If the fuel to air ratio changes due to events remote from the control device, the control device will detect the change in current and will then follow the steps previously outlined to reestablish the desired level of excess air. The added flexibility of a modulating appliance is that in addition to maintaining a single desired burner operating point, the control device can request an increase or decrease in the firing rate, i.e., heating capacity of the appliance. If a request for a change in the firing rate is made, the control device will set the new fuel flow and a new corresponding air flow to provide a combustible gas mixture containing some portion of excess air. The control device then allows conditions to stabilize at the new fuel flow setting. After the stabilization period, the control device repeats the previously described steps to attain the peak current level, i.e., stoichiometric fuel to air ratio, after which the control device can again offset to any desired level of excess air by a simple multiplication factor applied to either the fuel or air flow.

The apparatus may also be employed as a safety device by incorporating a shutdown procedure that will close the gas valve if performance demands on the gas valve or air blower exceed safe operational limits or fall below predetermined levels.

The present invention comprises a method for controlling the operation of a gas burner apparatus in which at least the air flow is variable, said control method comprising the steps of:

a) igniting the mixed fuel gas and combustion air;

b) monitoring the degree of ionization of the gases resulting from the combustion of the air and the fuel gas, in the burner apparatus;

c) varying the rate of supply of combustion air to the burner apparatus, so as to attain a maximum degree of ionization of the gases, for a fuel gas being supplied to the burner apparatus, so as to enable identification of the equivalence ratio of the fuel and air being supplied to the burner apparatus (this maximum degree of ionization corresponding to a near stoichiometric ratio of fuel to air); and d) setting the rate of supply of combustion air to a desired rate so as to establish a desired equivalence ratio of the fuel and air being supplied to the burner apparatus.

The invention further comprises the step of:

e) adjusting as necessary the rate of supply of combustion air so as to maintain the equivalence ratio of the fuel gas and air being supplied to the burner apparatus at the desired ratio.

In a preferred embodiment of the invention, prior to the ignition of the gas and air, the method further comprises the steps of:

i.) supplying a fuel gas to a mixing location;

ii.) supplying combustion air to the mixing location;

iii.) mixing the fuel gas and the combustion air; and iv.) delivering the mixed fuel gas and combustion air to a burner apparatus.

The present invention also comprises a method for controlling the operation of a gas burner apparatus in which at least the fuel flow is variable, said control method comprising the steps of:

a) igniting the mixed fuel gas and combustion air;

b) monitoring the degree of ionization of the gases resulting from the combustion of the air and the fuel gas, in the burner apparatus;

c) varying the rate of supply of fuel gas to the burner apparatus, so as to attain a maximum degree of ionization of the gases, for a fuel gas being supplied to the burner apparatus, so as to enable identification of the equivalence ratio of the fuel and air being supplied to the burner apparatus (the maximum degree of ionization corresponding to a near stoichiometric ratio of fuel to air); and d) setting the rate of supply of fuel gas to a desired rate so as to establish a desired equivalence ratio of the fuel and air being supplied to the burner apparatus.

The invention further comprises the step of:

e) adjusting as necessary the rate of supply of fuel gas so as to maintain the equivalence ratio of the fuel gas so as to maintain the equivalence ratio of the fuel gas and air being supplied to the burner apparatus at the desired ratio.

In a preferred embodiment of the invention, prior to the ignition of the gas and air, the method further comprises the steps of:

i.) supplying a fuel gas to a mixing location;

ii.) supplying combustion air to the mixing location;

iii.) mixing the fuel gas and the combustion air; and iv.) delivering the mixed fuel gas and combustion air to a burner apparatus.

The invention also comprises an apparatus for controlling the operation of a gas burner of the type in which at least the fuel gas is supplied to the burner apparatus in a regulable manner. The control apparatus comprises a sensor for sensing the degree of ionization of the gases burned in the burner apparatus, operably disposed within the burner apparatus. The sensor is capable of generating a signal representative of the degree of ionization of the burned gases. Means are provided for varying the rate of flow of fuel gas into the burner apparatus. A controller is operably associated with the sensor, and the means for varying the rate of flow of fuel gas, for increasing or decreasing the flow of fuel gas in response to the degree of ionization of the burned gases in the burner apparatus, towards maintaining the fuel gas and air in the burner apparatus in a desired equivalence ratio.

In a preferred embodiment of the invention, the controller further comprises memory apparatus for retaining data corresponding to the degree of ionization of the burned gases in the burner apparatus; and means for comparing a current degree of ionization of the burned gases, as sensed by the sensor, relative to the stored data.

The invention also comprises, in an alternative embodiment, an apparatus for controlling the operation of a gas burner of the type in which at least the combustion air is supplied to the burner apparatus in a regulable manner, in which a sensor is provided for sensing the degree of ionization of the gases burned in the burner apparatus, operably disposed within the burner apparatus. The sensor is capable of generating a signal representative of the degree of ionization of the burned gases. Means for varying the rate of flow of combustion air into the burner apparatus are provided, as is a controller, operably associated with the sensor, and the means for varying the rate of flow of combustion air, for increasing or decreasing the flow of combustion air in response to the degree of ionization of the burned gases in the burner apparatus, towards maintaining the fuel gas and air in the burner apparatus in a desired equivalence ratio. The controller further comprises memory apparatus for retaining data corresponding to the degree of ionization of the burned gases in the burner apparatus; and means for comparing a current degree of ionization of the burned gases, as sensed by the sensor, relative to the stored data.

The step of monitoring the degree of ionization of the gases is accomplished, in one embodiment, by positioning a flame ionization rod at a suitable location in the burner apparatus, establishing an electrical potential between the flame ionization rod and a grounding structure electrically connected to the burner apparatus, and observing the variation of the output current as a function of the ionization of the gases, and wherein the step of controlling the flow rate of combustion air so as to attain a maximum degree of ionization of the gases further comprises the step of varying the flow of combustion air while observing the output current to seek a peak in the output current, substantially corresponding to a maximum degree of ionization of the gases.

The step of varying the flow of combustion air while observing the output current further comprises the steps of:

i) making an observation of the output current;

ii) altering the flow of combustion air by an incremental amount, iii) making a further observation of the output current;

iv) calculating the change of the output current;

v) if there is an increase in the output current, comparing the change of the output current to a preselected value;

vi) halting the alteration of air flow if the change in the output current is less than the preselected value;

vii) if there is a decrease in the output current, changing the direction of the incremental change in the air flow rate;

viii) repeating steps ii–vii until the changing of the combustion air flow rate is halted.

One embodiment of the method further includes the steps of:

storing in memory, the most recent value for the output current;

comparing a present value for the output current to the most recent value for the output current; and changing the direction of the incremental change in the air flow rate, if there is a decrease in the output current.

An alternative embodiment of the method further includes the steps of:

storing in memory, the most recent value for the output current;

comparing a present value for the output current to the most recent value for the output current; and halting the changing of the combustion air flow rate if the difference between the present value and the most recent value is less than a predetermined value.

In an alternative embodiment of the invention, the step of monitoring the degree of ionization of the gases is accomplished by positioning a flame ionization rod at a suitable location in the burner apparatus, establishing an electrical potential between the flame ionization rod and a grounding structure electrically connected to the burner apparatus, and observing the variation of the output current as a function of the ionization of the gases, and wherein the step of controlling the flow rate of fuel gas so as to attain a maximum degree of ionization of the gases further comprises the step of varying the flow of fuel gas while observing the output current to seek a peak in the output current, substantially corresponding to a maximum degree of ionization of the gases.

In such an alternative embodiment, the step of varying the flow of fuel gas while observing the output current further comprises the steps of:

i) making an observation of the output current;

ii) altering the flow of fuel gas by an incremental amount, iii) making a further observation of the output current;

iv) calculating the change of the output current;

v) if there is an increase in the output current, comparing the change of the output current to a preselected value;

vi) halting the alteration of fuel gas flow if the change in the output current is less than the preselected value;

vii) if there is a decrease in the output current, changing the direction of the incremental change in the fuel gas flow rate;

viii) repeating steps ii–vii until the changing of the fuel gas flow rate is halted.

In one embodiment, the method further includes the steps of:

storing in memory, the most recent value for the output current;

comparing a present value for the output current to the most recent value for the output current; and changing the direction of the incremental change in the fuel gas flow rate, if there is a decrease in the output current.

In another embodiment, the method further includes the steps of:

storing in memory, the most recent value for the output current;

comparing a present value for the output current to the most recent value for the output current; and halting the changing of the fuel gas flow rate if the difference between the present value and the most recent value is less than a predetermined value.

Alternatively, the step of varying the flow of combustion air while observing the output current further comprises the steps of:

i) making an observation of the output current;

ii) altering the flow of combustion air by an incremental amount, iii) making a further observation of the output current;

iv) calculating the change of the output current;

v) if there is a decrease in the output current, changing the direction of the incremental change in the air flow rate and observing the output current, until an increase in the output current is observed;

vi) making another incremental change in the air flow rate;

vii) repeat steps iii–vi;

viii) halting the changing of the combustion air flow rate if the value of the difference between consecutive output current values is less than a predetermined value.

In still another alternative embodiment, the step of varying the flow of fuel gas while observing the output current further comprises the steps of:

i) making an observation of the output current;

ii) altering the flow of fuel gas by an incremental amount, iii) making a further observation of the output current;

iv) calculating the change of the output current;

v) if there is a decrease in the output current, changing the direction of the incremental change in the fuel gas flow rate and observing the output current, until an increase in the output current is observed;

vi) making another incremental change in the fuel gas flow rate;

vii) repeat steps iii–vi;

viii) halting the changing of the fuel gas flow rate if the value of the difference between consecutive output current values is less than a predetermined value.

The invention also comprises a method for controlling the operation of a gas burner apparatus, said control method comprising the steps of:

a) igniting the mixed fuel gas and combustion air;

b) monitoring the degree of ionization of the gases resulting from the combustion of the air and the fuel gas, in the burner apparatus;

c) varying the rate of supply of at least one of the combustion air and the fuel gas to the burner apparatus, so as to attain a maximum degree of ionization of the gases, for a fuel gas being supplied to the burner apparatus, so as to enable identification of the equivalence ratio of the fuel and air being supplied to the burner apparatus; and d) setting the rate of supply of at least one of the combustion air and the fuel gas to a desired rate so as to establish a desired equivalence ratio of the fuel and air being supplied to the burner apparatus.

BEST MODE FOR PRACTICING THE INVENTION

Figure 1:
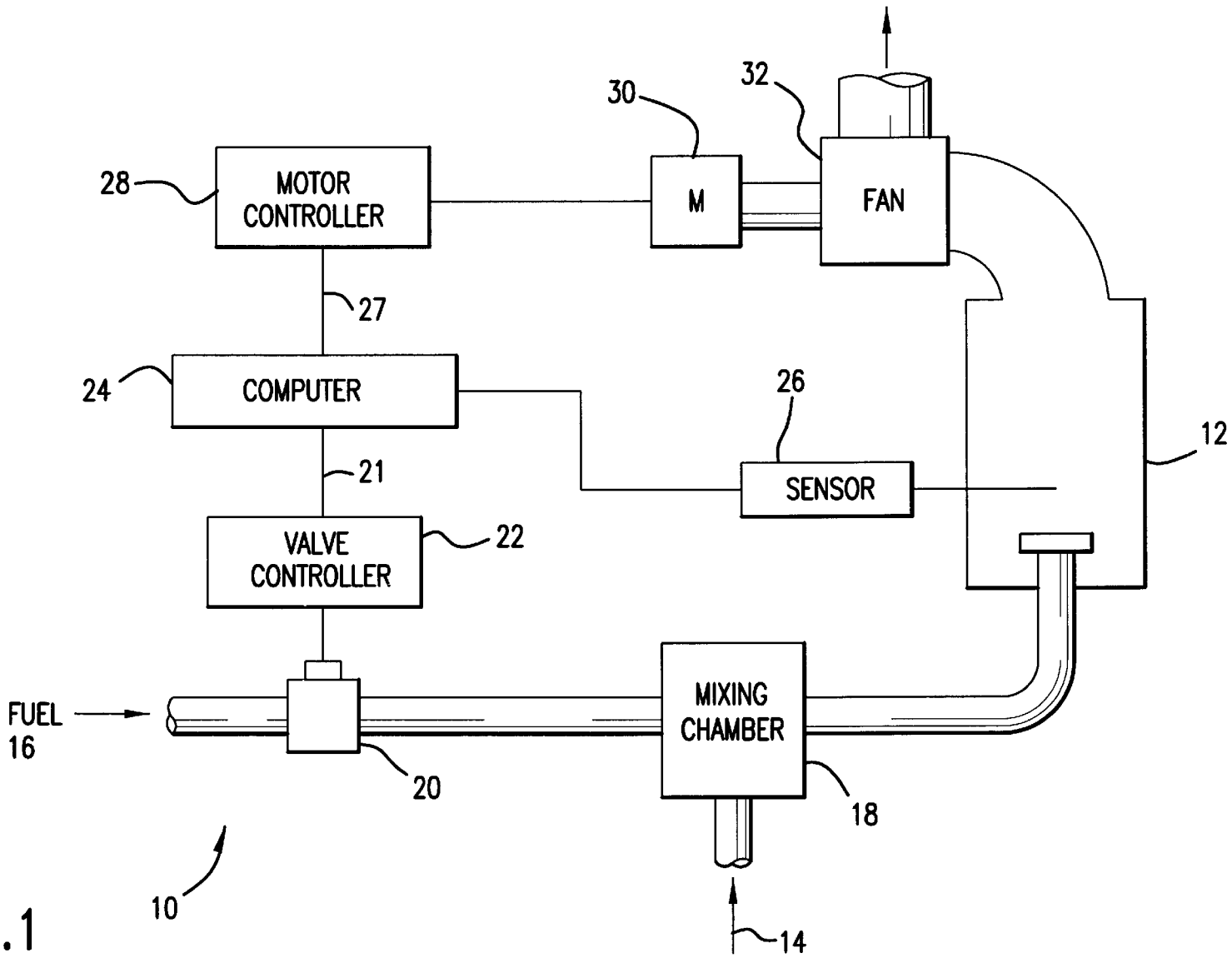
FIG. 1 is a schematic illustration of a burner and control apparatus, according to the present invention, in an induced-draft burner configuration.

While this invention is susceptible of embodiment in many different forms, there is shown in the drawings and will be described herein in detail, several specific embodiments, with the understanding that the present invention is to be considered as an exemplification of the principles of the invention and is not intended to limit the invention to the embodiments illustrated.

The preferred embodiments of the invention, which are illustrated in the figures employ variable speed fans and may or may not employ variable fuel valves. However, the method and apparatus of the present invention can also be employed in an appliance having a fixed speed fan and a variable fuel valve. One having ordinary skill in the art and having the present disclosure before them may readily modify the steps in the modes of operation described herein, to accommodate such an alternate appliance configuration. The present invention can be utilized so long as the gas appliance is provided with either a variable speed fan or a variable fuel valve, at a minimum.

FIG. 1 is a schematic illustration of an appliance 10, including an induced draft burner 12. Appliance 10 includes air source 14, fuel source 16, mixing chamber 18 (which may be configured according to known principles), fuel valve 20 (which may have any suitable configuration, although a multi-position or modulable configuration is preferred), valve controller 22, computer/processor/controller 24, flame ionization sensor 26, motor controller 28, motor 30 (which is preferably a variable speed motor) and fan 32.

In an alternative embodiment, an appliance 40 (FIG. 2) is a powered burner appliance. The individual components, while arranged in a different configuration, are or can be the same as in the induced burner appliance 10 of FIG. 1, and accordingly, like reference numerals have been utilized to indicate like components.

In each of the appliances 10, 40, to obtain the greatest advantage from the control method of the present invention, both fan 32 and fuel valve 20 should be capable of fully modulating operation, although stepped multistage operating components could also be used.

The computer/processor/controller 24 which may be used in an appliance 10, 40, may be a PC or any suitably programmable microprocessor. A conventional valve controller 22 may be used. A conventional motor controller 28 may be used.

Figure 3:
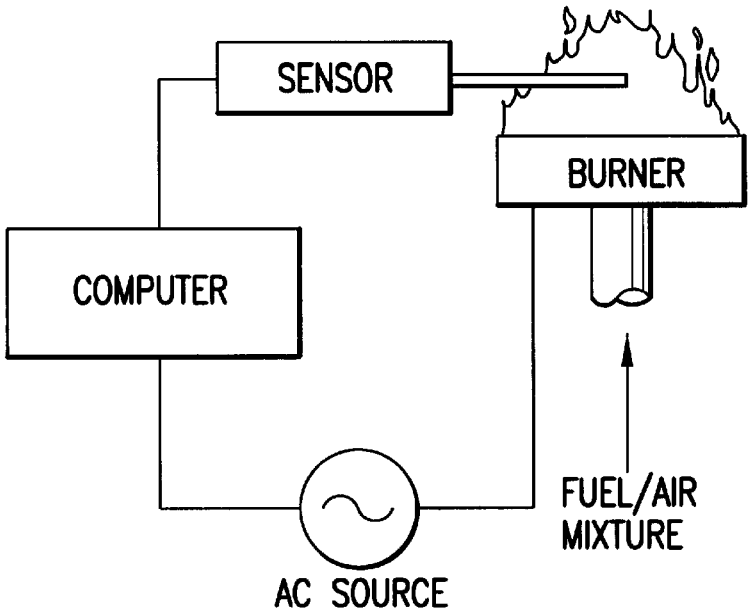
FIG. 3 is a highly schematic illustration of a flame ionization sensor circuit in accordance with the present invention.

FIG. 3 illustrates, highly schematically, a typical sensor/burner circuit loop, as may be used in accordance with the method of the present invention. Flame ionization sensor 26, which may be of known design, will be mounted in the burner 12. The output 25 of sensor 26 will be fed into controller 24. User input 23, which may come from a thermostat (in the case of a furnace or other HVAC appliance) or a temperature control knob (cooking appliance), will tend to be an instruction of the form that the burner should attain a desired firing rate or temperature.

Controller 24, in turn, communicates, via connections 21, 27 (FIG. 1), to valve controller 22 and motor controller 28, which together are responsible for the actual physical control of the fuel and air flow rates. Sensor 26 can provide information regarding the status of a flame in burner 12 in two ways. If there is no flame, then sensor 26 will generate a signal which, in the manner described herein, will be interpreted as flame failure, which when reported to controller 24, will cause controller 24 to instruct valve controller 22 to shut off fuel flow and, if desired increase or decrease the fan speed. This is the known function and utilization of flame ionization sensors, such as sensor 26.

Sensor 26, in the method and apparatus of the present invention, is used to monitor and control the air/fuel ratio of the appliance. It has been determined that, with respect to premixed air/fuel burners, the electrical signal output from sensors such as sensor 26 peak at or near stoichiometric air/fuel ratio conditions, regardless of the firing rate. The absolute amplitude of the sensor signal will vary with firing rate, but the sensor signals will always peak in a range around an equivalence ratio of 1.0.

The method of the present invention, while suitable for use with premixed burners, does not appear to work with so-called diffusion flame burners, i.e., those burners which derive most of their combustion air from ambient surroundings around the flameholder—although the present invention still offers potential for an improvement with respect to such diffusion burners as well. Accordingly, in a preferred embodiment of the invention, it will be desirable to ensure that the burner geometry and the air supply is always sufficient to ensure that the primary air which is premixed with the fuel is adequate to ensure safe and efficient burning, and that the "secondary" air, to which the open flame is exposed in the burner, has minimal effect upon the combustion process.

The flame sensor should be located at a physical location in the burner which permits sensing of the equivalence ratio through the full range of firing rates of which the appliance is capable.

Figure 2:
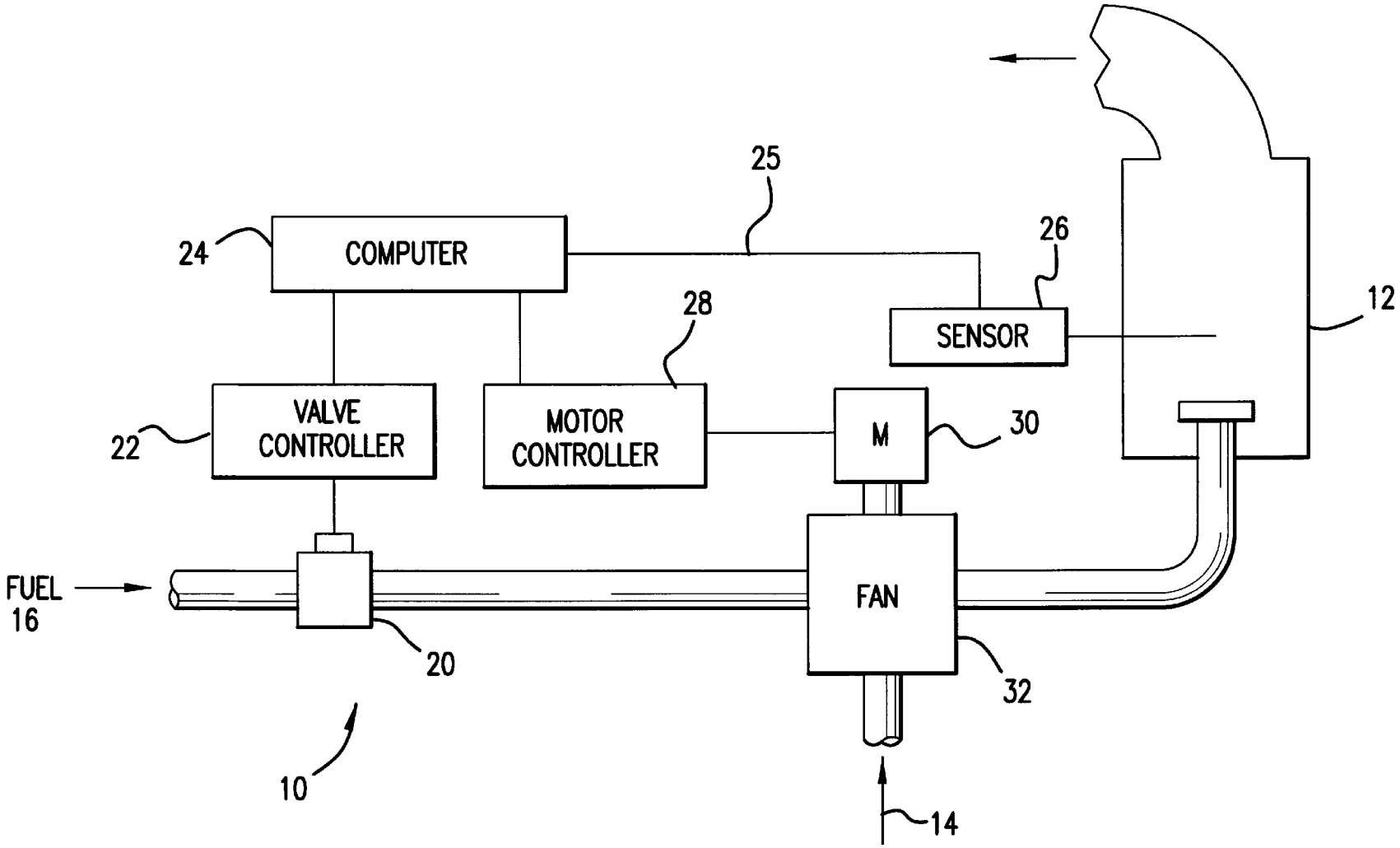
FIG. 2 is a schematic illustration of a burner and control apparatus, according to the present invention, in a powered burner configuration.

In either of the embodiments of FIGS. 1 and 2, of the present invention, utilizing a flame sensor as previously described, a voltage, such as a 120 AC voltage, will be applied across the sensor, with the flame holder serving as the ground electrode. As described herein, flame contact between the sensor and the flameholder will close the circuit and produce a current level which is related to the air-fuel ratio of the sensed flame. The alternating current (AC) output of the sensor/ground circuit, can be rectified, if the ground electrode (flameholder) is substantially larger in size than the positive electrode (sensor), since, due to the difference in electrode size, more current flows in one direction than in the other. The resulting AC current can then be rectified to a pulsing direct current (DC). The larger the area ratio of the ground electrode to the positive electrode, the greater the bias in current direction, and the more readily the signal can be rectified. It is believed that in practical system applications, the ground electrode area preferably should be at least four times greater than the area of the positive electrode, in order to achieve a large bias in current direction.

Figure 10:
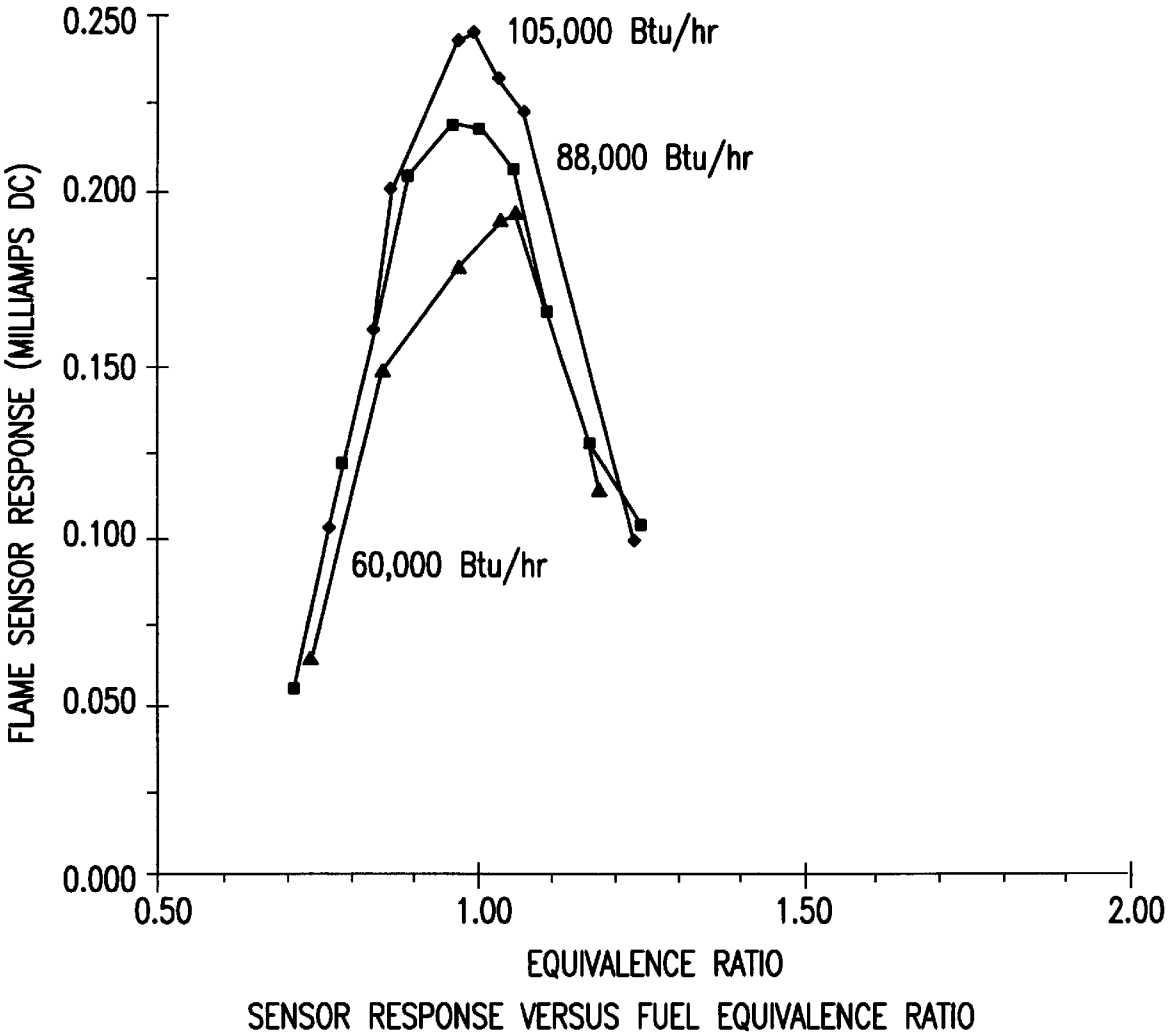
FIG. 10 is a plot showing actual sensor output for a representative premixed burner at various firing rates and equivalence ratios.

Flame ionization sensors 26 are electrodes, preferably made out of a conductive material which is capable of withstanding high temperatures and steep temperature gradients. Hydrocarbon flames conduct electricity because of the charged species (ions) which are formed in the flame. Placing a voltage across the flame sensor and the flame-holder causes a current to flow when a flame closes the circuit. The magnitude of the current (sensor signal) is related to the ion concentration in the flame. The ion concentration is a function of flame temperature, which, in turn, is a function of the air-fuel ratio. Since the peak flame temperature occurs at or near the stoichiometric air-fuel ratio, the ion concentration is also highest at this condition. Therefore, the peak sensor signal (current) occurs at, or near, the stoichiometric flame (equivalence ratio, $\Phi=1$) condition. FIG. 10 illustrates flame sensor response characteristics (sensor response versus $\Phi$), which have been observed in a flame sensor installed in a premixed, perforated-cone burner in a Weil McLain boiler.

As a part of the control system for the present invention, appropriate methods of processing the signals being generated by the sensor must be employed. In a sensor system according to a preferred embodiment of the invention, the sensor is driven by 120V, 60 Hz AC. The raw output current is substantially single-sided AC (in view of the bias created by the difference in surface area of the ground and the positive electrodes). This means that during the positive phase of the power source oscillation, the current flows through the flame and a signal is measured. During the negative phase of the power source oscillation, substantially no current (by contrast) flows through the flame, and there is no significant signal.

The output signal should then be conditioned to eliminate the one-sided AC current effect and produce an apparently continuous signal. The signal should then be filtered to remove unusable and potentially disruptive (i.e., >5 Hz) information.

In order to remove the 60 Hz power source signature from the raw signal, the output of the sensor is passed through a low pass filter with a cut-off frequency of 0.1 Hz.

It has been observed that sensor response peaks at an equivalence ratio close to 1.0 over a wide range of firing rates. It is appropriate to apply a control logic which employs peak seeking, as described herein.

Figure 4:
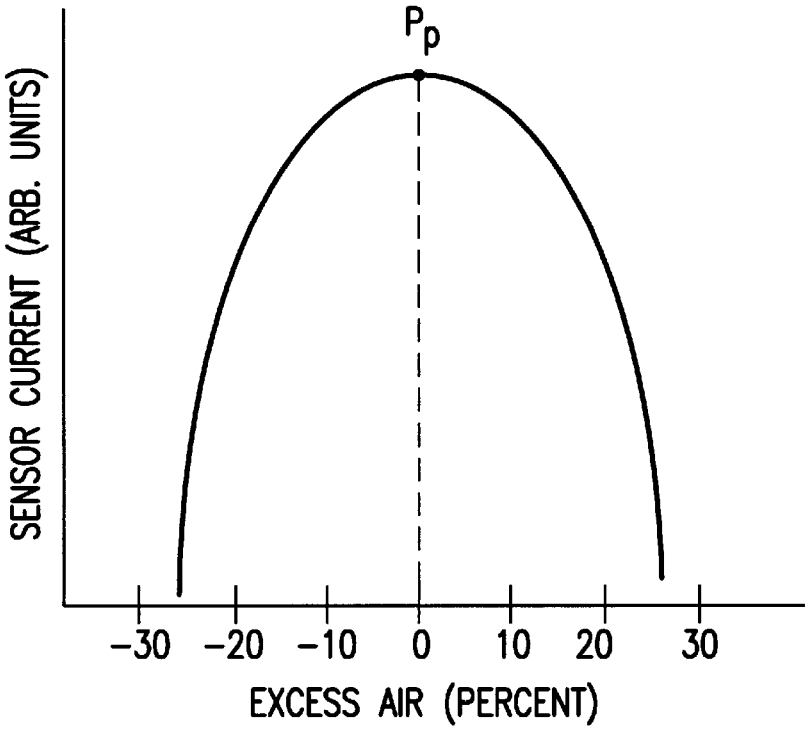
FIG. 4 is a schematic illustration of sensor response (current) as a function of excess air level in a burner according to the present invention.

In order to provide a proper method for controlling operation of the burner, the signal output of the sensors must be clearly understood. As previously described, FIG. 4 illustrates a normalized and idealized plot of sensor output current as a function of the percentage of excess air, for a mixture of air and fuel, which, for the purposes of demonstration is presumed to have a current peak exactly at zero percent excess air. Under dynamic conditions (changing firing rates), the output will tend to have a quick response component, which is believed to be the result of the change in firing rate (and corresponding change in gas ionization concentration), and a slow response component (believed to be related to heat transfer effects in the vicinity of the burner).

Figure 8:
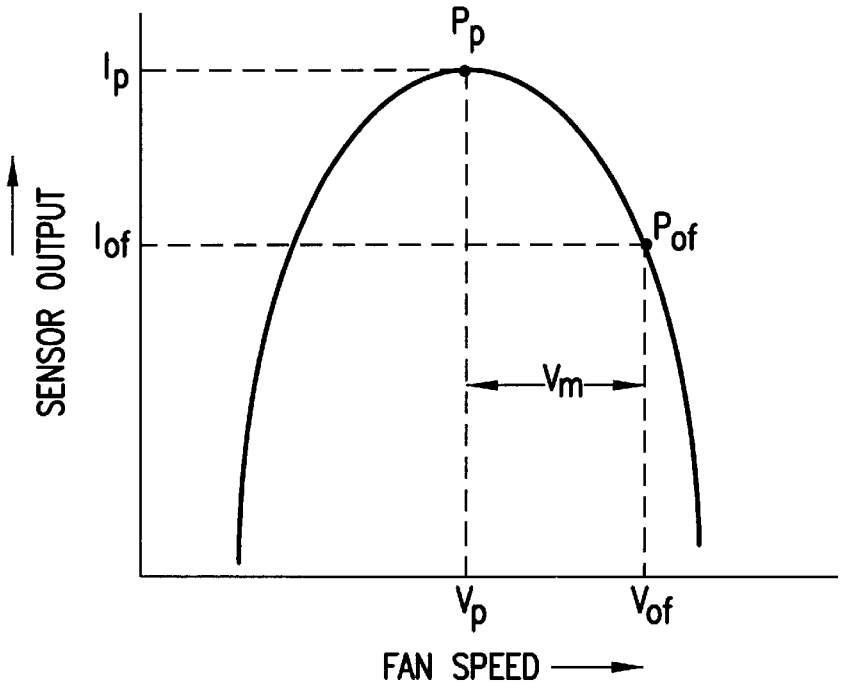
FIG. 8 is a schematic illustration of sensor output relative to fan speed, illustrating offset operations following the peak seeking process.

Different types of known controller methodology may be applied to the present invention, so long as the particular controller which is used is of the kind known as a peak seeking controller, which will initially find the peak sensor output value for a given firing rate and physical set-up. Once the peak has been found, either through anticipation of the peak, or through a procedure for passing through the peak, the operation can continue with the peak being maintained, or with an offset from peak current conditions (see FIG. 8), as may be desired. Some known types of controller methods which may be employed include switching controllers, self-driving controllers, hill climbing controllers, perturbation controllers (most likely, this kind would be used, for initial start-up of the burner, and then operation would be switched to a different controller).

Figure 5:
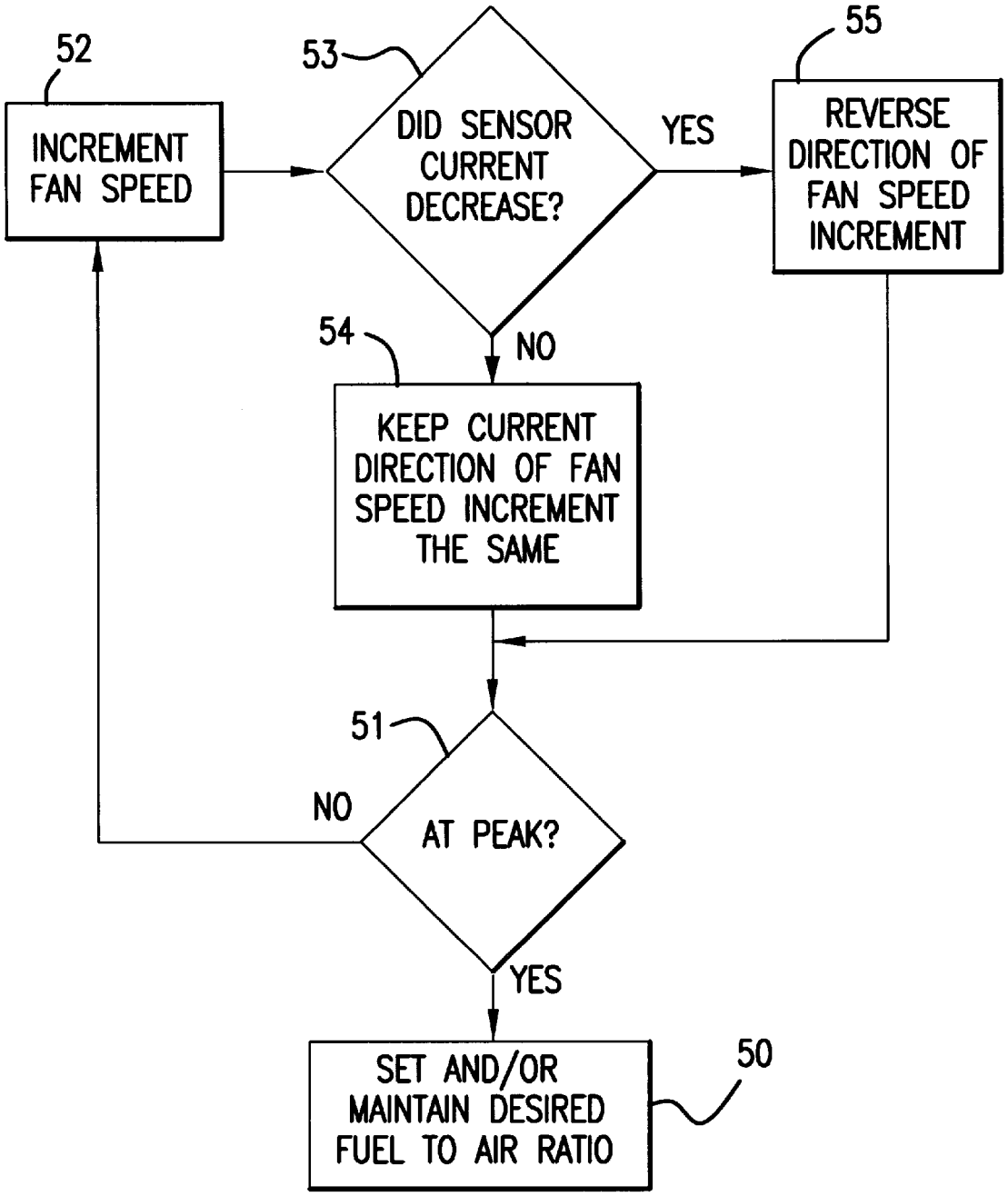
FIG. 5 is a schematic illustration of the operation of peak seeking logic, in accordance with the present invention.

FIG. 5 is a flow chart diagram of a possible control method. At start-up 50, the user will dictate the gas flow rate of the appliance (such as by thermostat setting) or, alternatively, the appliance will have a default start-up gas flow setting preprogrammed or otherwise preset into controller 24. Alternatively, the controller 24 will use a look-up table stored in memory to establish initial fuel and air flows. For example, the controller 24 may first reference the preprogrammed look-up tables for correct fan voltage and fuel valve settings necessary to operate at $\Phi\approx0.9$ for the given firing rate (which might be set by a user, in the case of a stove or oven, for example). Air flow will commence at this predetermined initial value. For purposes of safety, quick start-up and low CO emissions, an air flow rate which would assure excess air (lean burning) is selected. The controller then sets the fan voltage and air flow begins. An ignitor, such as a hot surface ignitor, heats up to ignition temperature, and then fuel flow is initiated. Ignition occurs. As soon as the sensor detects the presence of a flame, the controller waits a predetermined period of time (e.g., 15 seconds) to allow the system to reach a stable state. The controller 24 will then move to the appropriate control mode, such as the peak seeking or peak anticipating modes discussed herein.

Air flow will commence at some predetermined initial value, based upon the initial fan speed. For purposes of safety and quick start-up, an air flow rate which would assure excess air typically will be selected. Ignition occurs. In peak seeking mode a sensor reading is taken and stored in memory in controller 24. Upon start-up, the controller assumes that the system is not actually at stoichiometric conditions, and a step change in the air blower output is spontaneously made at 52. After a preselected time period (for example, to permit the flame to stabilize), another sensor reading is taken and compared to the previous sensor reading stored in memory in control apparatus 24. If the recent value has changed relative to the previously-stored value, the controller decides, at 53, to make a further step in blower output, in the same direction (step 54), or to reverse the direction of the fan speed increment (step 55). This process repeats until the peak sensor response is attained.

Figure 6:
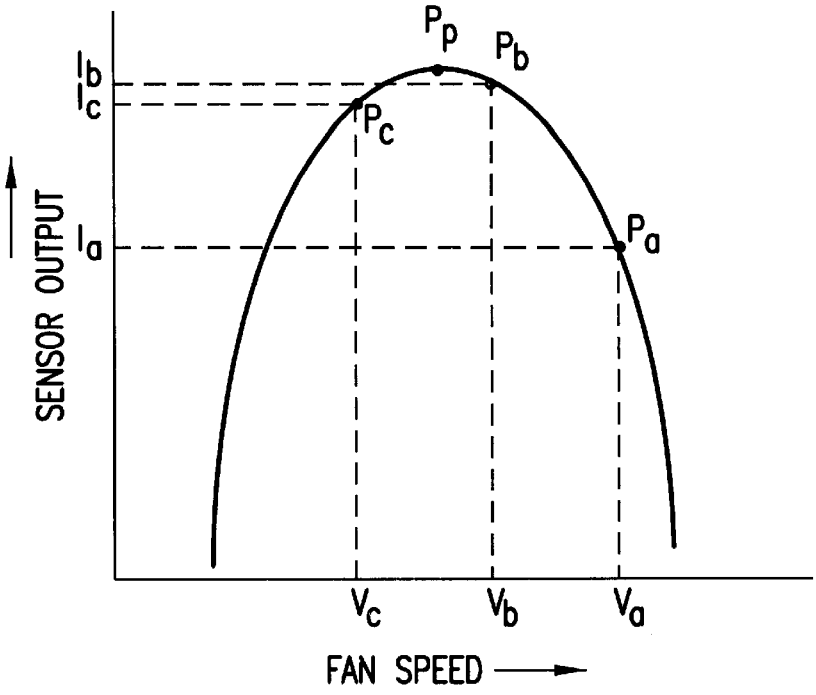
FIG. 6 is a schematic illustration of sensor output (normalized) relative to fan speed, illustrating the peak seeking process.

FIG. 6 illustrates three steps or points ($P_a$, $P_b$, and $P_c$) in such a peak seeking process, in which the system might initially start at point $P_a$, which may be intentionally selected to have considerable excess air. An initial decrement to the fan speed may result in an output current corresponding to point $P_b$. Since the value of the output current has increased, the system will decrement the air flow a similar amount ($V_a$–$V_b$), to arrive at $V_c$, and having an output current $I_c$, which being less than $I_b$, will cause the controller 24, if suitably programmed, according to known programming techniques, to reverse the direction of the changes in fan speed, and potentially also change the absolute value of the increment, so as to assure that the next point (not shown) will be between $V_c$ and $V_b$.

Alternatively, the peak may be determined by observing the change in the output signal, for example, by monitoring the slope of the output signal versus fan speed (i.e., air flow rate) curve. When the slope of the curve approaches zero, the peak has been anticipated. This method for finding the peak in this manner is referred to as "peak anticipating".

The peak current can be anticipated, as the controller incrementally increases air flow, for example, by observing the changes in the output current, as the air flow is varied in uniform, predetermined increments/decrements. In "peak anticipating" it is important that the peak be approached from the "lean" side, but not crossed over, since it has been determined that each time the peak is crossed, the flame passes through a zone in which an unacceptable amount of CO (>400 ppm) is produced. Accordingly, it is important to stop the incrementing of the air flow, before the peak is actually attained, since it is not practically possible to "hit" the peak without passing it first. Accordingly, a safe margin must be established, such that when, for a given increment of air flow, the change in current output, relative to the most recent sampling, will be small enough, to indicate to the controller that the slope of the current versus the change in air flow is "flattening out", indicating that a peak is being approached, and that the incrementing process should be halted. For any given combination of apparatus, burner type, and fuel type, the "safe margin" may vary, and the safe margin will typically be determined empirically, utilizing known techniques. The safe margin, for each appliance, equivalence ratio, and firing rate, should be set so that upon arriving at the boundary of the safe margin, the peak value can be reliably predicted to be within 4–5% of the most recent increment of the air flow.

Figure 7:
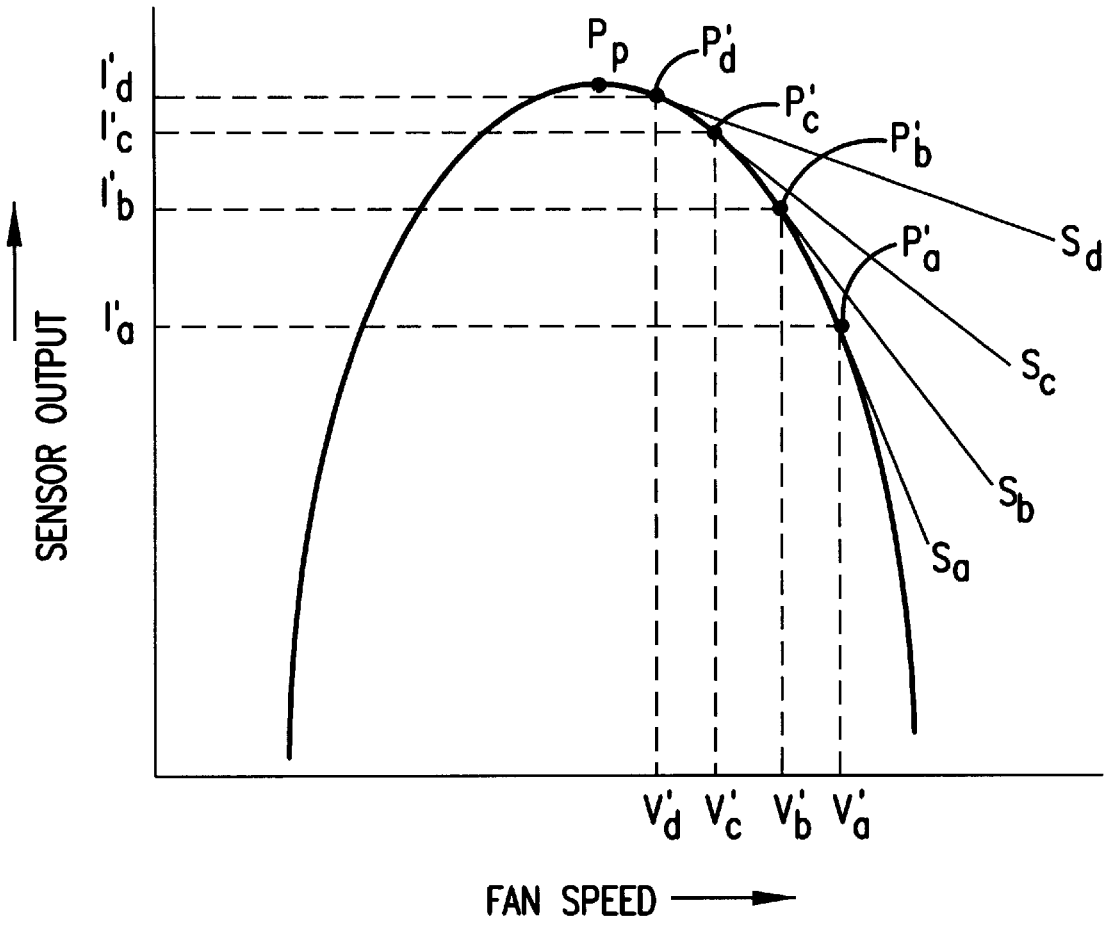
FIG. 7 is a further schematic illustration of sensor output (normalized) relative to fan speed, illustrating the peak seeking process.
Figure 9:
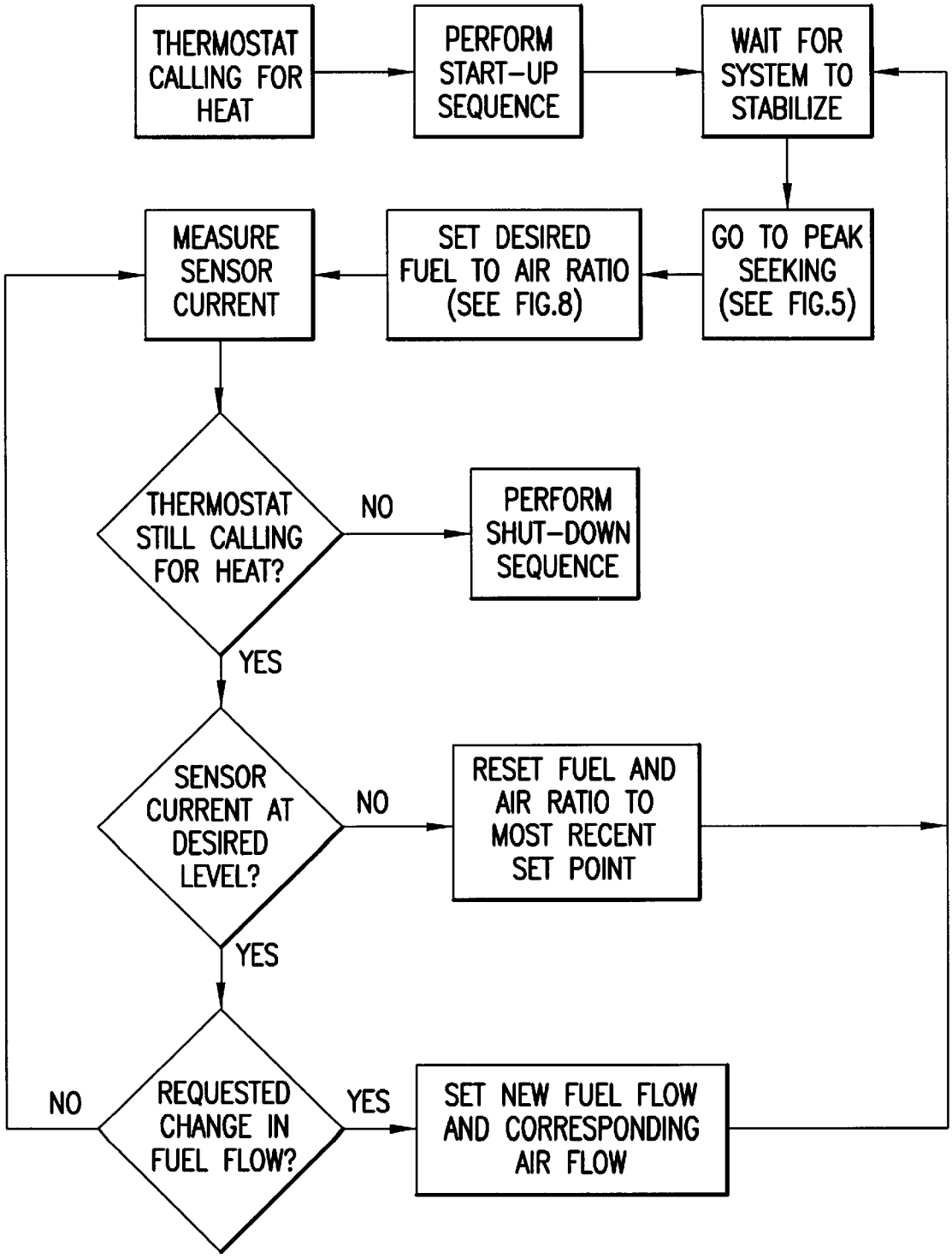
FIG. 9 is a schematic illustration of overall controller operation for an appliance operating according to the principles of the present invention.

FIG. 7 illustrates peak anticipating. Upon start-up, again a fan voltage (and speed) $V'_a$ is selected which ensures excess air at the start. The fan speed is then decremented to $V'_b$, the absolute value of the decrement being purposefully selected to be sufficiently small that multiple decrements will be required in order to approach the peak current. The slope of the line connecting $P'_a$ and $P'_b$ is calculated, and presumed to be a usable approximation of the actual slope of the fan speed v. output current curve. The decrementing, and calculation of slopes continues, until the slope $S_d$ is found which is sufficiently small that the peak is deemed to be sufficiently accurately predicted.

Once the peak has been found or anticipated, the controller, as discussed, will increase the airflow required for peak sensor response by some predetermined amount, for example, 25%. This will result in an offset burner stoichiometry in which the normalized ratio of fuel to air (equivalence ratio) is less than one. After offsetting the burner, the controller 24 again waits a predetermined amount of time to allow the system to stabilize, after which the controller may go into steady state operations/monitoring mode.

During monitoring mode, the controller continuously monitors the steady state response of the sensor and waits either for 1) a user/preprogrammed thermostat-requested change in the firing rate, or 2) a change in sensor response due to changes in burner stoichiometry.

Once steady state conditions have been achieved (no change in sensor value over a predetermined time period), then the sensor signal will be monitored, preferably continuously or substantially continuously, to see if the signal is within a predetermined range, since a very small amount of signal drift (plus or minus 3–5%) may be expected, even during steady state operations.

If there is a user/thermostat commanded firing rate change, the operation is as follows. A commanded firing rate change can be either an increase or decrease in firing rate. In either situation, the controller will first reference the stored look-up tables to determine the required air and fuel flow settings to bring the burner up to an equivalence ratio of 0.9 for the new firing rate. If the request is for an increase in firing rate, the controller will first increase the air flow, then increase the fuel flow, so as to be sure to maintain excess air at all times. If the request is for a decrease in firing rate, the controller will first decrease fuel flow, then decrease air flow, so as to maintain excess air burning conditions.

If the new firing rate is substantially different than the current firing rate, then preferably the controller will be programmed to increment/decrement the actual gas flow in steps, e.g., units of 5000 BTU/hr, so as to prevent the flame from blowing out due to a sudden increase in the relative amount of air or a sudden decrease in the relative amount of fuel. The controller will then wait for flame stabilization, before going into peak seeking/anticipating mode.

One having ordinary skill in the art, with the present disclosure before them, would also be able to modify the process as described above, so as to require the calculation of only a single "slope" (change of current over change in gas or air flow rate). Such a method could be used when the initial air and gas flow rates which are selected when the burner is initially ignited, are such that the anticipated equivalence ratio will be very close to, and preferably just below, one. The size of the incremental change in air or gas could then be empirically determined, so as to put the resultant burner conditions, after one increment, within the safe margin discussed herein. A slope, which would correspond to a point on the curve that is within such a safe margin, could then be also empirically determined, and if such a slope is indeed calculated to be present, after only one increment, then the peak anticipating procedure stops after only a single increment. Such a procedure is also contemplated as being within the scope of the present invention.

The controller should also be appropriately configured to accommodate changes in burner stoichiometry which result, for example, from changes in fuel quality, fan performance, flue plugging, etc. Such a change may be detected by setting the controller to watch for a sudden change in the current value, beyond a predetermined value. In such an eventuality, the controller will be programmed to first attempt to reset the fuel and air flow to an equivalence ratio of 0.9 at the current firing rate. This is done to reestablish a known point from which to begin peak seeking. After reestablishing the set points for air and fuel flow, the controller will wait and then return to peak seeking.

The control method described, with minor variations, can be used in a system in which the fuel flow (as opposed to the air flow) is variable.

As previously mentioned, the specific details of operation of a system such as disclosed herein will depend upon the specific application (appliance being controlled), the specific sensor type and make used, sensor positioning, the fuel chemistry, and so on.

The magnitude of the sensor response is, in part, believed to be a function of the available area of electrical contact being formed by the burner—flame sensor configuration. That is, the greater the area of contact between the burner flame and the flame holder, and the greater the area of contact between the flame itself and the flame sensor, the stronger the output signal will be. Sensor placement will also affect the strength of the output. While even in steady state conditions, there can be expected some variability in output, due to slight flow rate fluctuations, etc., it is believed that a burner controlled according to the present invention can be maintained at within 5% of the desired equivalence ratio, over a wide turndown ratio range of at least up to 6 to 1, making this control system suitable for application in a wide variety of commercial and residential uses, as previously described.

It is believed that the best performance for this control method and apparatus can be obtained in burner configurations in which the fuel gas and air are premixed and controllable, with little or no effect on the flame being produced by "secondary" air.

In addition, the control apparatus and method of the present invention can be provided using individually known, relatively low-cost components, suitable for use in lower cost applications, such as residential appliances, and can operate over a wide range of burner firing rates, such as are encountered in residential boilers and furnaces, gas-fired cooling systems and stoves and cooking appliances.

The present invention is a method and apparatus for controlling the operation of a gas burner. A flame ionization sensor is placed within the burner, and the degree of ionization of the burned gases in the burner is observed. For a known fuel and fuel flow rate, the degree of ionization, which is observed, may be understood to correspond to the equivalence ratio of fuel gas to combustion oxygen. The rate of flow of fuel gas into the burner is controlled directly by the user or based upon instructions to a control device by the user.

By adjusting the rate of flow of at least some or all of the combustion air into the burner, the equivalence ratio of fuel to oxygen in the burner can be altered. Monitoring the degree of ionization of burned gases provides feedback to the control of combustion air flow. Once a desired equivalence ratio is attained, then the degree of ionization corresponding to that desired ratio will be maintained.

As can be seen from the foregoing, a gas burner appliance employing the control method and apparatus will be able to maintain a desired combustion equivalence ratio, through a variety of firing rates, notwithstanding changes in fuel or air characteristics, and can enable the same type and rating of appliance to be utilized in different geographic locations, thus eliminating the need for providing specially configured apparatus for, for example, high altitude locations, or locations having available fuel which has a quality different from a "standard" fuel quality.

The present invention can also be employed in various kinds of gas burner configurations, utilizing many different types of gas fuel, such as natural gas, town gas, propane, butane, etc., since the control apparatus and method of the present invention automatically seeks the appropriate equivalence ratio, for the particular fuel and air quality.

The present invention also permits the control of a burner apparatus so as to maintain the flame conditions at the stoichiometric ratio or at some preselected offset from stoichiometric, at various firing rates, without having to actually know the numerical values for the flow rates for the fuel gas and combustion air, once an initial, excess-air flame condition has been established.

It is also understood that one of ordinary skill in the art, having the present disclosure before them, can apply the principles herein to a gas-fired apparatus, wherein the gas flow and combustion air flow are both fully modulable, or at least variable a plurality of non-zero flow rates, so as to accomplish the overall procedure of peak seeking by varying either of the gas or combustion air flows, as may be desired.

The present invention is configured to provide control without requiring that the precise composition of the gas or the gas and air flow rates be precisely known (apart from a rough approximation necessary to initially establish a flame before starting peak seeking), although the method and apparatus of the present invention can also be advantageously employed in burner systems in which the gas composition and/or the gas and/or air flow rates are known with accuracy.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

We claim:

1. A method for controlling operation of a gas burner apparatus, the method comprising the steps of:

a) igniting a mixture of fuel gas and combustion air;

b) monitoring a degree of ionization of gases resulting from combustion of the combustion air and the fuel gas;

c) varying a rate of supply of the combustion air to the burner apparatus and attaining a maximum degree of ionization of the gases at a fixed rate of supply of the fuel gas to the burner apparatus and identifying a first equivalence ratio of the fuel gas and the combustion air at the maximum degree of ionization; and d) fixing the rate of supply of the combustion air and establishing a second equivalence ratio of the fuel gas and the combustion air wherein the second equivalence ratio is less than the first equivalence ratio, and operating the gas burner apparatus at the second equivalence ratio.

2. The method according to claim 1 wherein:

i.) an electrical potential is established between a flame ionization sensor contacting the gases and a grounding structure electrically connected to the burner apparatus, ii.) a variation in an output current corresponding to the electrical potential is monitored as a function of the ionization of the gases, iii.) a first value of the output current is identified at a first rate of supply of the combustion air;

iv.) the rate of supply of the combustion air is incremented in a first direction, v.) a second value of the output current is identified at the incremented rate of the supply of the combustion air; and vi.) the maximum degree of ionization is determined by comparing the second value to the first value.

3. The method according to claim 2, wherein the rate of supply of the combustion air is further incremented in the first direction if the second value is greater than the first value.

4. The method according to claim 3, wherein the rate of supply of the combustion air is incremented in a second direction which is opposite the first direction if the second value is less than the first value.

5. The method according to claim 2, wherein the rate of supply of the combustion air is incremented in a second direction which is opposite the first direction if the second value is less than the first value.

6. The method according to claim 5, wherein the rate of supply of the combustion air is further incremented in the first direction if the second value is greater than the first value.

7. The method according to claim 1 wherein, prior to igniting the mixture, the method further comprises the steps of:

i.) supplying the fuel gas to a mixing location;

ii.) supplying the combustion air to the mixing location; and iii.) mixing the fuel gas and the combustion air to form the mixture of the fuel gas and the combustion air.

8. The method according to claim 1, wherein:

i.) an electrical potential is established between a flame ionization sensor and a grounding structure electrically connected to the burner apparatus, ii.) a variation in an output current corresponding to the electrical potential is monitored as a function of the ionization of the gases, and iii.) a peak in the output current is identified substantially corresponding to a maximum degree of ionization of the gases.

9. The method according to claim 8, wherein:

a first value of the output current is identified at a first rate of supply of the combustion air;

the rate of supply of the combustion air is incremented in a first direction;

a second value of the output current is identified at the incremented rate of the supple of the combustion air; and the maximum degree of ionization is determined by comparing the second value to the first value.

10. The method according to claim 9 wherein:

the first value is stored in memory; and the second value is compared to the memory stored first value; and wherein the rate of supply of the combustion air is incremented in a second direction which is opposite the first direction if the second value is less than the memory stored first value.

11. The method according to claim 9, wherein:

the first value is stored in memory; and the second value is compared to the memory stored first value.

12. A method for controlling operation of a gas burner apparatus, the method comprising the steps of:

a) igniting a mixture of fuel gas and combustion air;

b) monitoring a degree of ionization of gases resulting from combustion of the combustion air and the fuel gas;

c) varying a rate of supply of the fuel gas to the burner apparatus and attaining a maximum degree of ionization of the gases at a fixed rate of supply of the combustion air to the burner apparatus and identifying a first equivalence ratio of the fuel gas and the combustion air at the maximum degree of ionization; and d) fixing the rate of supply of the fuel gas and establishing a second equivalence ratio of the fuel gas and the combustion air wherein the second equivalence ratio is less than the first equivalence ratio, and operating the ias burner apparatus at the second equivalence ratio.

13. The method according to claim 12 wherein:

i.) an electrical potential is established between a flame ionization sensor contacting the gases and a grounding structure electrically connected to the burner apparatus, ii.) a variation in an output current corresponding to the electrical potential is monitored as a function of the ionization of the gases, iii.) a first value of the output current is identified at a first rate of supply of the fuel gas;

iv.) the rate of supply of the fuel gas is incremented in a first direction, v.) a second value of the output current is identified at the incremented rate of the supply of the fuel gas; and vi.) the maximum degree of ionization is determined by comparing the second value to the first value.

14. The method according to claim 13, wherein the rate of supply of the fuel gas is further incremented in the first direction if the second value is greater than the first value.

15. The method according to claim 14, wherein the rate of supply of the fuel gas is incremented in a second direction which is opposite the first direction if the second value is less than the first value.

16. The method according to claim 13, wherein the rate of supply of the fuel gas is incremented in a second direction which is opposite the first direction if the second value is less than the first value.

17. The method according to claim 16, wherein the rate of supply of the fuel gas is further incremented in the first direction if the second value is greater than the first value.

18. The method according to claim 12 wherein, prior to igniting the mixture, the method further comprises the steps of:

i.) supplying the fuel gas to a mixing location;

ii.) supplying the combustion air to the mixing location; and iii.) mixing the fuel gas and the combustion air to form the mixture of the fuel gas and the combustion air.

19. The method according to claim 12, wherein;

i.) an electrical potential is established between a flame ionization sensor and a grounding structure electrically connected to the burner apparatus, ii.) a variation in an output current corresponding to the electrical potential is monitored as a function of the ionization of the gases, and;

iii.) a peak in the output current is identified substantially corresponding to a maximum degree of ionization of the gases.

20. The method according to claim 19, wherein:

a first value of the output current is identified at a first rate of supply of the fuel gas;

the rate of supply of the fuel gas is incremented in a first direction;

a second value of the output current is identified at the incremented rate of the supply of the fuel gas; and the maximum degree of ionization is determined by comparing the second value to the first value.

21. The method according to claim 20 wherein:

the first value is stored in memory;

the second value is compared to the memory stored first value; and wherein the rate of supply of the fuel gas is incremented in a second direction which is opposite the first direction if the second value is less than the memory stored first value.

22. The method according to claim 20, wherein:

the first value is stored in memory; and the second value is compared to the memory stored first value.

23. An apparatus for controlling the operation of a gas burner in which a fuel gas is supplied to a burner apparatus in a regulable manner, the control apparatus comprising:

a sensor for sensing a degree of ionization of gases resulting from combustion of the fuel gas with a combustion air, the sensor operably disposed within the burner apparatus and generating a signal representative of the degree of ionization of the gases;

first means for varying a rate of supply of the fuel gas into the burner apparatus; and a controller operably associated with the sensor and the first means for varying the rate of supply of the fuel gas, the controller emitting a first signal to the first means so that the first means varies the rate of supply of the fuel gas in response to a sensed degree of ionization of the gases, and the controller emitting a second signal to the first means so that the first means fixes the rate of supply of the fuel gas and the combustion air and operates the burner apparatus at an equivalence ratio which is different than a stoichiometric equivalence ratio occurring at a maximum degree of ionization of the gases.

24. The control apparatus according to claim 23, wherein the controller farther comprises:

a memory apparatus for storing data corresponding to the sensed degree of ionization of the gases; and second means for comparing a current degree of ionization of the gases, as sensed by the sensor, relative to the stored data.

25. An apparatus for controlling the operation of a gas burner in which a combustion air is supplied to a burner apparatus in a regulable manner, the control apparatus comprising:

a sensor for sensing a degree of ionization of gases resulting from combustion of a fuel gas with the combustion air, operably disposed within the burner apparatus and generating a signal representative of the degree of ionization of the gases;

first means for varying a rate of supply of the combustion air into the burner apparatus; and a controller operably associated with the sensor and the first means for varying the rate of supply of the combustion air, the controller emitting a first signal to the first means so that the first means varies the rate of supply of the combustion air in response to a sensed degree of ionization of the gases, and the controller emitting a second signal to the first means so that the first means fixes the rate of supply of the fuel gas and the combustion air and operates the burner apparatus at an equivalence ratio which is different than a stoichiometric equivalence ratio occurring at a maximum degree of ionization of the gases.

26. The control apparatus according to claim 25, wherein the controller further comprises:

a memory apparatus for storing data corresponding to the sensed degree of ionization of the gases; and second means for comparing a current degree of ionization of the gases, as sensed by the sensor, relative to the stored data.

27. An apparatus for controlling the operation of a gas burner apparatus in which a fuel gas and a combustion air are mixed prior to introduction into the burner apparatus, wherein the gas burner apparatus includes means for supplying a known fuel gas to a mixing location at a known rate of supply, means for supplying the combustion air to the mixing location at a known rate of supply, means for mixing the fuel gas and the combustion air, means for delivering the mixed fuel gas and combustion air to the burner apparatus, and means for igniting the mixed fuel gas and combustion air, the control apparatus comprising:

means for monitoring a degree of ionization of gases resulting from the combustion of the air and the fuel gas, in the burner apparatus;

means for varying the rate of supply of the combustion air to the burner apparatus;

means for controlling the rate of supply of the combustion air to attain a maximum degree of ionization of the gases, for a known fuel gas being supplied to the burner apparatus at a known rate, so as to enable identification of a first equivalence ratio of the fuel gas and the combustion air at the maximum degree of ionization; and means for fixing the rate of supply of the combustion air and establishing a second equivalence ratio of the fuel gas and the combustion air wherein the second equivalence ratio is less than the first equivalence ratio.

28. The control apparatus according to claim 27, further comprising:

means for adjusting the rate of supply of the combustion air to maintain the second equivalence ratio of the fuel gas and the combustion air less than the first equivalence ratio.

* * * * *